US005635305A

United States Patent [19]

Haga et al.

[11] Patent Number: 5,635,305

[45] Date of Patent: Jun. 3, 1997

[54] MACHINABLE CAST-IN-PLACE TUBE ENCLOSURE FITTINGS

[75] Inventors: David J. Haga, Lapeer; James D. McDaniel, Ortonville, both of Mich.; Roger B. Nagel, Wauscon, Ohio

[73] Assignee: ITT Automotive, Inc., Auburn Hills, Mich.

[21] Appl. No.: 446,219

[22] Filed: May 22, 1995

[51] Int. Cl.[6] ..... B32B 3/20

[52] U.S. Cl. ..... 428/577; 428/586; 428/596

[58] Field of Search ..... 428/586, 577, 428/596, 583

[56] References Cited

U.S. PATENT DOCUMENTS

| | | | |
|---|---|---|---|
| 1,372,673 | 3/1921 | Cunningham | 164/98 |
| 2,965,959 | 12/1960 | Horne et al. | 428/586 |
| 3,709,280 | 1/1973 | MacMillan | 164/112 |
| 3,853,309 | 12/1974 | Widmer | 266/41 |
| 3,863,701 | 2/1975 | Niimi et al. | 164/98 |
| 4,003,422 | 1/1977 | Schramm et al. | 164/9 |
| 4,148,352 | 4/1979 | Sensui et al. | 164/112 |
| 4,209,058 | 6/1980 | Spalding | 164/100 |
| 4,276,994 | 7/1981 | Spalding | 220/454 |
| 4,344,477 | 8/1982 | Miki et al. | 164/98 |
| 4,604,779 | 8/1986 | Narita et al. | 29/156.4 WL |
| 4,637,110 | 1/1987 | Yamagata | 29/156.4 WL |
| 4,676,064 | 6/1987 | Narita et al. | 60/272 |
| 4,700,444 | 10/1987 | Yamagata | 29/156.4 WL |
| 4,715,178 | 12/1987 | Tsukuda et al. | 60/272 |
| 4,719,677 | 1/1988 | Arnold | 29/156.4 R |
| 4,749,624 | 6/1988 | Dete et al. | 428/586 |
| 4,817,257 | 4/1989 | Mascarenas | 29/156.4 R |
| 4,829,642 | 5/1989 | Thomas et al. | 29/6 |
| 4,832,106 | 5/1989 | Bücking et al. | 164/98 |
| 4,858,670 | 8/1989 | Field et al. | 164/11 |
| 4,865,112 | 9/1989 | Schwarb et al. | 164/34 |
| 4,958,537 | 9/1990 | Diehl et al. | 74/606 R |
| 4,969,263 | 11/1990 | Adams | 29/888.06 |
| 5,111,872 | 5/1992 | Diehl et al. | 124/98 |
| 5,129,444 | 7/1992 | Bafford | 164/112 |

*Primary Examiner*—John Zimmerman
*Attorney, Agent, or Firm*—Thomas N. Twomey; J. Gordon Lewis

[57] ABSTRACT

An end fitting closes at least one end of a passageway having an external periphery and an internal periphery to be cast-in-place within a part. A fitting body has at least one elongated, blind-ended aperture formed therein. The aperture is defined at least in part by a first surface having a complimentary shape with respect to the external periphery of the cast-in-place passageway for receiving an end of the passageway disposed extending at least partially therein to close the passageway during casting of the part. The fitting body is composed of material essentially identical to material being used during casting of the part. The fitting body is positionable within a casting mold for forming the part to be cast, such that machining the cast part after casting opens the blind-end of the fitting to allow fluid flow through the passageway cast-in-place within the part. The end fitting may include a shaped aperture, such as a hexagonal shape or oval shape, for receiving a complimentary shaped nut on the conduit or complimentary shaped passageway to provide orientation of the passageway with respect to the fitting when connected thereto.

36 Claims, 4 Drawing Sheets

MACHINABLE CAST-IN-PLACE TUBE ENCLOSURE FITTINGS

FIELD OF THE INVENTION

The invention relates to a method of making an article having a plurality of open-ended, internal, passageways, and in particular, to an end fitting for closing an end of the passageway, such as a tubular conduit, allowing the surface of the cast part to be machined in order to open the end of the passageway while eliminating bi-metallic machining complications.

BACKGROUND OF THE INVENTION

It is generally known in the manufacture of heat transferable castings, or castings having internal fluid passages for lubrication or the like to cast metal around a tube through which liquid or gas can be passed. The tube may be shaped to suit the form of the casting and situated where the maximum heat transference is required. The tube in this way forms a passage which will not leak irrespective of the soundness of the casting and may provide a conduit of shape which could not be achieved through normal casting techniques using cores. In the past, various techniques have been employed to manufacture cast articles or parts, such as crankshaft for internal combustion engines or transmission housing components or the like, wherein the part includes a plurality of open-ended, internal passages for supplying fluid to desired locations. One typical approach involves casting the part in a suitable mold and then drilling the passages in the cast part. Passages formed by drilling are limited to linear configurations. Moreover, drilling produces metal chips and other debris that must be removed from the passages. It has also been known to form all passages within a part as a single serpentine tube with portions of the tube removed after casting the part in order to open the individual passageways through the part, or to form a bundle of tubular conduits to be cast in situ where an end portion of each conduit has a selvage portion that is crimped closed to preclude the metal used in the casting operation from intruding within the passageways. In either case, large amounts of scrap conduit are generated using these casting techniques, increasing the cost of production for these parts. In addition, if the parts require surface machining in the vicinity of the cast-in-place passageways, bi-metallic machining complications exist when using these known techniques of casting passageways in place.

SUMMARY OF THE INVENTION

It is desirable in the present invention to provide a simpler, more precise, and less costly method of forming fluid passages in cast articles or parts. It is expected that the present invention can be adapted for use in castings using metal, ceramic, plastic or hybrid composition components. It is desirable in the present invention to reduce, or eliminate, the complications associated with bi-metallic machining of surfaces having cast-in-place passageways formed therein. The present invention provides an end fitting for closing at least one end of a passageway having an external periphery and an internal periphery to be cast-in-place within a part. A fitting body is provided having at least one elongated, blind-ended, aperture formed therein. The aperture is defined at least in part by a first surface having a complimentary shape with respect to the external periphery of the cast-in-place passageway for receiving an end of the passageway disposed extending at least partially therein to close the passageway during casting of the part. The fitting body preferably is composed of a material essentially identical to the material used during casting of the part. The fitting body is positionable within a casting mold for forming the part to be cast, such that machining the cast part opens the blind-end of the fitting to open the passageway cast-in-place within the part.

The end closure fitting according to the present invention can be made of the same material as the casting. This eliminates bi-metallic machining complications. The fittings are designed to be opened during existing or common machining processes of the part, such as facing to eliminate special processes to open the tube to fluid flow. The end closure fitting can be used as a locator with a tit or projection on the end further enhancing processing of the fitting. The end of the fitting may also be concave, or convex in a cylindrical fashion, for a near net surface to the inside diameter or outside diameter of a cylinder or cylindrical shell. The preferred embodiment of the present invention uses a skyved tube when connecting to an angular end closure fitting. The cross-boring in the end fitting is precise and serves many purposes in conjunction with the skyved tube. The fitting is bored from the back deep to near the face. The thin wall remaining keeps material out when casting the article and is the portion removed when the cast article is bored or machined to open the tube to fluid flow. The cross-bore proceeds through the first bore, producing a recess which will support the remaining circumference of the skyved tube. The remaining semi-cylindrical surface left on the end of the skyved tube keeps material out when casting the article. A support may be used for supporting the span between ends of the tube to keep the tube from warping due to differential heating during the casting process. The result is a 90° flow path in a short distance. The present invention can be modified for different sizes and shapes of passages to be cast in place. Other configurations, straight flow through passages, 90° elbows, 45° elbows, T's or the like may also be provided in accordance with the present invention.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED AND ALTERNATIVE EMBODIMENT

Figure 1:
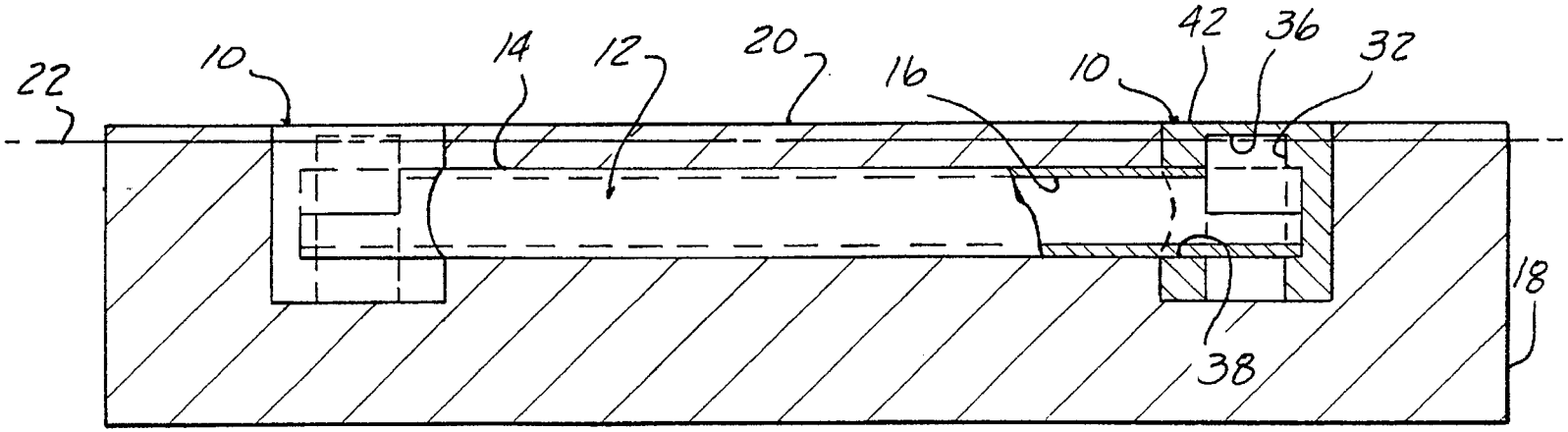
FIG. 1 is a cross-sectional view of a machinable cast-in-place tube end closure fitting according to the present invention.

The present invention relates to an end closure fitting 10 for closing at least one end of a passageway 12 having an external periphery 14 and an internal periphery 16 to be cast-in-place within a part 18. Referring now to FIGS. 1, a cross-section of the cast part 18 is illustrated with a first surface 20 corresponding to a surface formed by an appropriate mold (not shown) for forming the part 18 during the casting process. Openings communicating with the cast-in-place passageway 12 are initially closed by the end closure fitting 10 during the casting process, and can be opened when the cast part 18 is machined, or the like, during subsequent processing to the level of finish surface 22 shown in phantom. Machining first surface 20 by suitable machine operations to finish surface 22 removes a portion of the end closure fitting 10 opening the cast-in-place passageway 12 to fluid flow.

Figure 3:
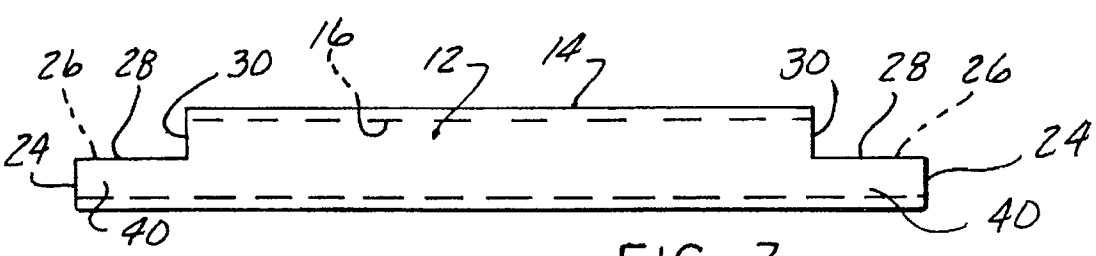
FIG. 3 is a side elevational view of a tube having skyved ends.
Figure 4:
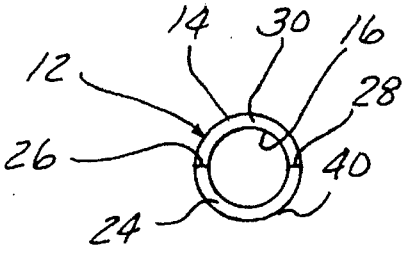
FIG. 4 is an end elevational view of the skyved tube of FIG. 3.

Referring now to FIGS. 3 and 4, the cast-in-place passageway 12 can include a tube of any size and cross-sectional configuration. For use with an angular end closure fitting 10, such as the 90° end closure fittings as illustrated in FIGS. 5–11, each end 24 of the passageway 12 is skyved. Each end 24 to be engaged with respect to an angled end closure fitting 10, such as a 90° fitting, is cut longitudinally forming diametrically opposed surfaces 26, 28 and cut radially along peripheral surface 30 forming a longitudinally and radially extending notch in the end 24 of the passageway 12.

Figure 2:
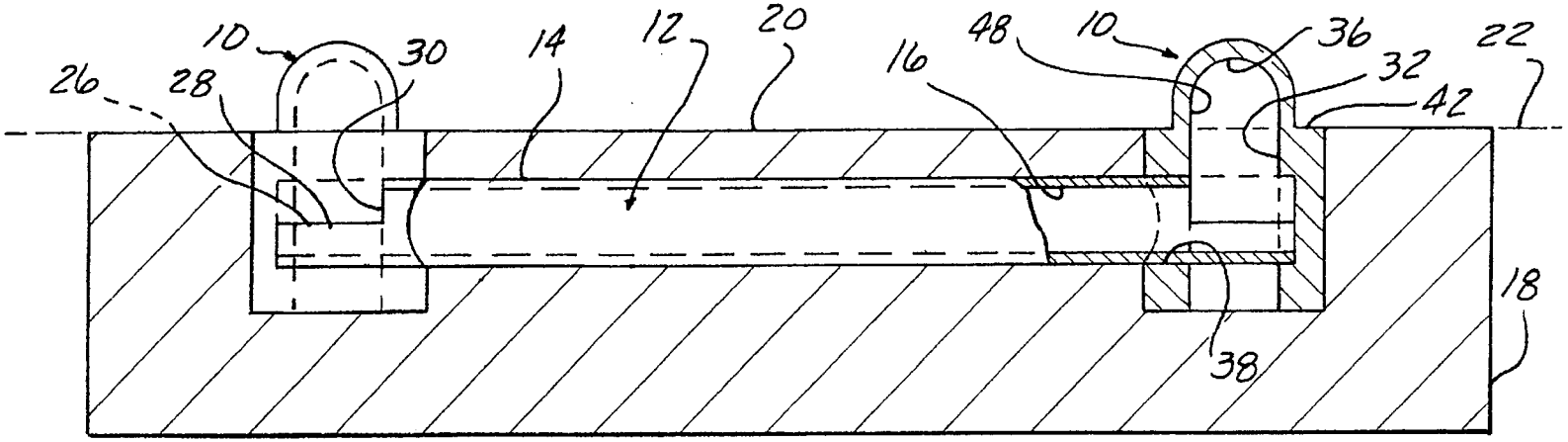
FIG. 2 is a cross-sectional view of an end closure fitting according to the present invention having a hollow locator protruding outwardly therefrom.
Figure 13:
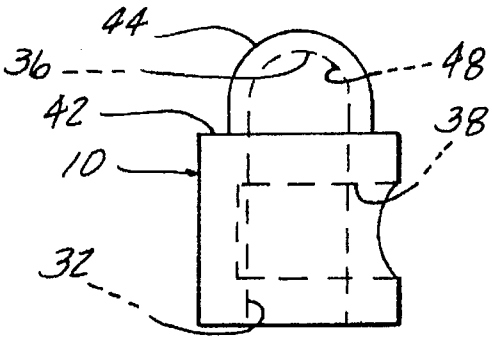
FIG. 13 is a side elevational view of the end closure fitting shown in FIG. 12.
Figure 12:
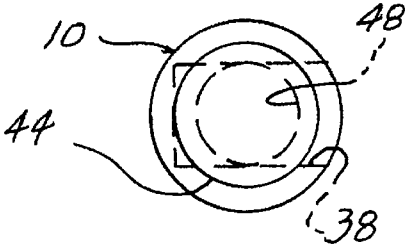
FIG. 12 is a plan view of an end closure fitting according to the present invention having a hollow locator pin formed on a surface thereof.
Figure 14:
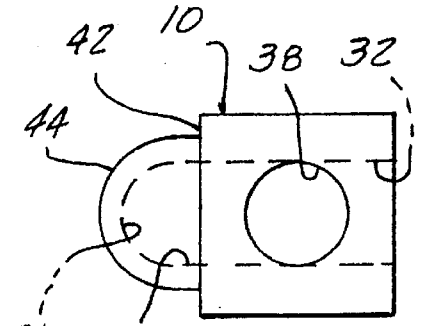
FIG. 14 is an end elevational view of the end closure fitting shown in FIG. 12.
Figure 11:
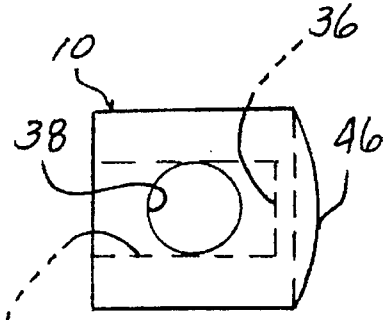
FIG. 11 is an end elevational view of the end closure fitting shown in FIG. 5 with a convex edge of the concave surface illustrated in FIG. 10.
Figure 10:
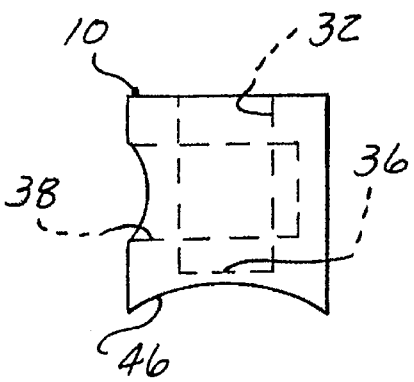
FIG. 10 is a side elevational view of the end closure fitting shown in FIG. 5 with a concave surface formed thereon.
Figure 9:
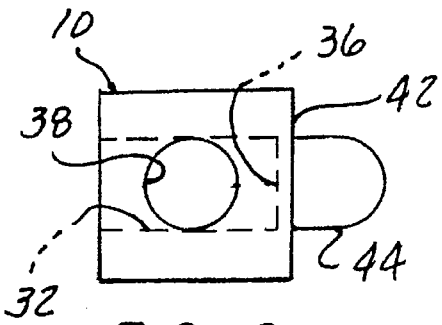
FIG. 9 is an end elevational view of the end closure fitting shown in FIG. 5 and FIG. 8 with a solid locator pin formed in one surface thereof.
Figure 8:
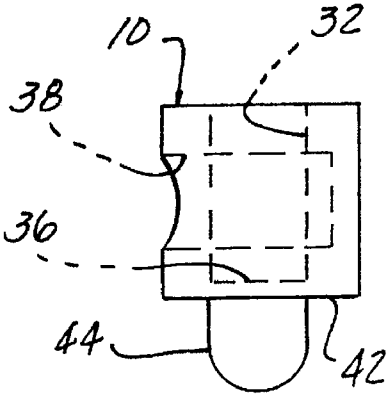
FIG. 8 is a side elevational view of the end closure fitting shown in FIG. 5 with a solid locator pin formed on one surface thereof.
Figure 7:
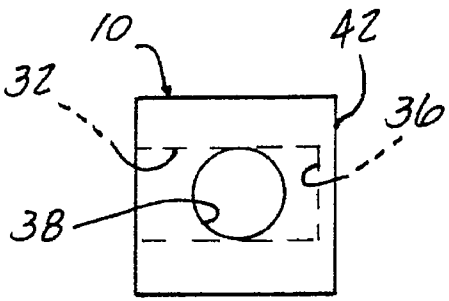
FIG. 7 is an end elevational view of the end closure fitting shown in FIG. 5.
Figure 5:
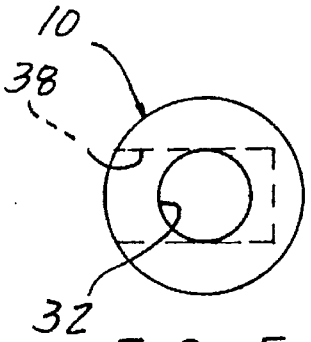
FIG. 5 is a plan view of an closure fitting according to the present invention.
Figure 6:
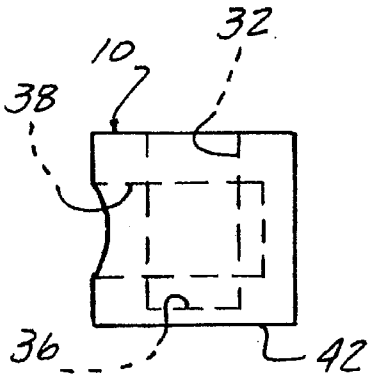
FIG. 6 is a side elevational view of the end closure fitting shown in FIG. 5.

Each end closure fitting 10 includes a fitting body having at least one elongated, blind-ended, aperture 32. The aperture 32 is defined at least in part by a first surface 34 having a complimentary shape with respect to the external periphery 14 of the cast-in-place passageway 12 for receiving an end 24 of the passageway 12 disposed extending at least partially therein to close the passageway during casting the part 18. The body of the end closure fitting 10 is preferably composed of material essentially identical to the material used during casting of the part. The use of identical material, or materials having comparable machining characteristics, reduce or eliminate the complications that occur with bi-metal machining operations. The body of the end closure fitting 10 is positionable within a casting mold for forming the part 18 to be cast, such that machining the cast part 18 opens the blind end 36 of the fitting 10 to open the passageway 12 cast-in-place within the part 18. In the angled fittings 10, such as a 90° fitting, a second aperture 38 having a complimentary shape with respect to the external periphery 14 of the cast-in-place passageway 12 is provided. The second aperture 38 can be disposed co-axial with the first aperture 32, or can be disposed at any desired angle with respect to the first aperture 32 as desired, such as the 90° angle fittings illustrated in FIGS. 5–12 of the present application. The thin blind end wall 36 remaining in the end closure fitting 10 keeps material out of the passageway 12 during casting of the part 18. The thin, blind end wall 36 is removed when the part 18 is subjected to machining processes after casting. The cross-bore, such as second aperture 38, proceeds through the first aperture 32 producing a recess which will support the remaining circumference of the skyved passageway 12. The remaining semi-cylindrical surface 40 left on the end 24 of the skyved tube 12 keeps material out of the passageway 12 while casting the part 18. As shown in FIGS. 5–7, the end closure fitting 10 can be formed with a flat, generally planar surface 42 exposed to the internal surface of the mold (not shown) used to form the part 18 during casting. As illustrated in FIGS. 5, 8 and 9, the end closure fitting 10 can include a locator pin 44 for engagement with the sidewall of the mold (not shown) used to form the part 18 during casting. The locator pin 44 assists in properly positioning and locating the external openings with respect to the cast-in-place passageway 12 to be positioned within the part 18 during casting. The locator pin 44 can be removed during subsequent machining operations after casting the part 18. As illustrated in FIGS. 5, 10 and 11, the end closure fitting 10 can be formed with a convex, or concave, surface 46 for closer fit to the corresponding surface of the mold (not shown), such that the surface 46 fits closely with respect to the corresponding to the inside diameter or outside diameter of a cylinder or cylindrical shell. As illustrated in FIGS. 12–14, the end closure fitting 10 can also include a hollow locator pin 44, such as that defined by surface 48, rather than the solid locator pin 44 as illustrated in FIGS. 5, 8 and 9. The hollow locator pin 44 can also be seen in FIG. 2. In order to open the passageway 12, while using the end closure fitting 10 with a hollow locator pin 44, it is only necessary to machine the locator pin 44 off at the first surface 20 of the part 18, corresponding to the finish surface 22.

Figure 17:
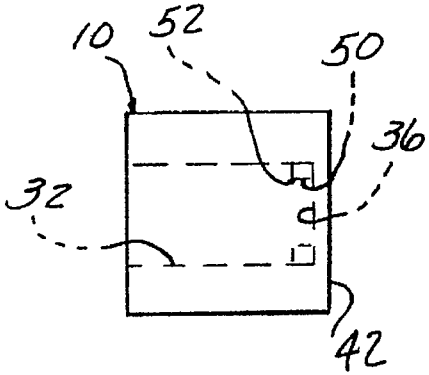
FIG. 17 is an end elevational view of the end closure fitting shown in FIG. 15.
Figure 15:
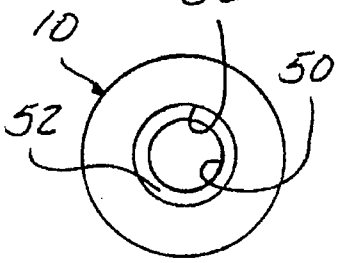
FIG. 15 is a plan view of an end closure fitting according to the present invention.
Figure 16:
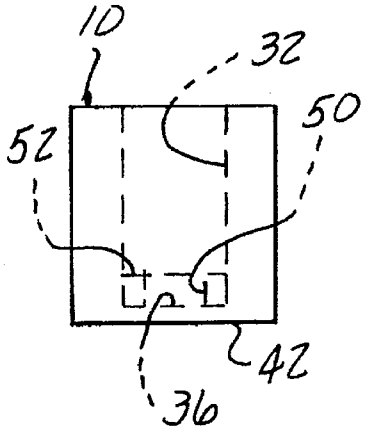
FIG. 16 is a side elevational view of the end closure fitting illustrated in FIG. 15.

Referring now to FIGS. 15–17, an end closure fitting 10 according to the present invention is illustrated for a straight flow through passageway. As previously described, the end closure fitting 10 includes an elongated, blind-ended, aperture 32 defined at least in part by a first surface 34. The blind end wall 36 is removed by subsequent machining operations as previously described with respect to FIG. 1 and the end closure fitting 10 illustrated in FIGS. 5–7. In this configuration of the end closure fitting 10, it is preferable to have a normal blunt end on passageway 12, rather than the skyved end as illustrated in FIGS. 3 and 4. In order to provide sufficient spacing from the finish surface 22 of the part, it is desirable to provide a longitudinally extending second surface 50, preferably formed having a complimentary shape to the internal periphery 16 of the passageway 12, or at the very least acting as a longitudinally extending projection from the blind end 36 in order to engage the blunt end of the passageway 12 so that sufficient distance is provided between the blind end 36 and the blunt end of the passageway 12 to allow for machining operations to the level of finish surface 22 to open the passageway 12 after casting. The second surface 50 can be formed as one or more longitudinally extending projections from the blind end 36 forming a shoulder 52 for engagement with the blunt end of the passageway 12. If more than one projection is provided, preferably the projections are equally angularly spaced about the longitudinal axis of the first aperture 32. Alternatively, the second surface 50 can be formed as a longitudinally and circumferentially extending surface complimentary in size and shape to the internal periphery 16 of the passageway 12.

Figure 21:
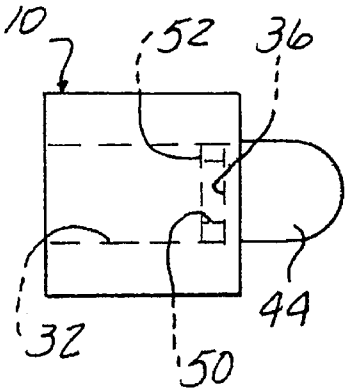
FIG. 21 is an end elevational view of the end closure fitting illustrated in FIG. 15 with the locator pin formed thereon.
Figure 19:
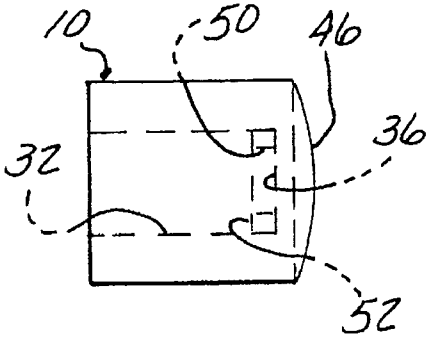
FIG. 19 is an end elevational view of the end closuring fitting shown in FIG. 15 with a convex edge of the concave surface illustrated in FIG. 18.
Figure 20:
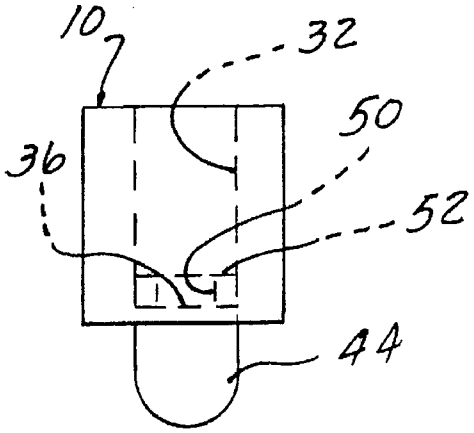
FIG. 20 is a side elevational view of the end closure fitting shown in FIG. 15 with a locator pin formed on a surface thereof.
Figure 18:
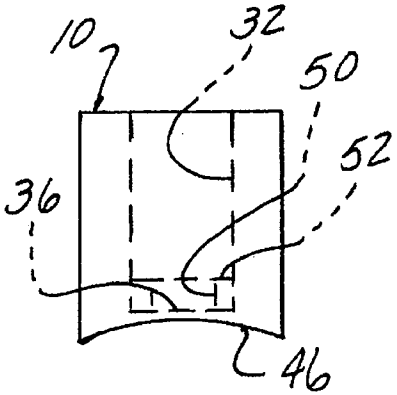
FIG. 18 is a side elevational view of the end closure fitting shown in FIG. 15 with a concave surface formed thereon.

The end closure fitting 10 can be formed with a flat, generally planar surface 42 for engagement with a wall of the mold (not shown) for forming the part 18 for casting. As illustrated in FIGS. 18 and 19, the end closure fitting 10 can be formed with a concave, or convex, surface 46 formed in a cylindrical fashion for a closer fit with respect to an inner diameter or outer diameter of a cylinder or cylindrical shell portion of the mold or part to be formed during casting. As illustrated in FIGS. 20 and 21, the end closure fitting 10 according to the present invention can include a solid or hollow locator pin 44 for engagement with a wall of the mold (not shown) for forming the part 18 during casting. The locator pin 44 assists in accurately positioning the passageway 12 to be cast-in-place, during the casting of part 18 within the mold.

Figure 24:
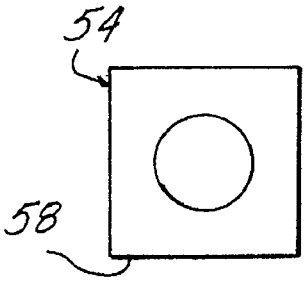
FIG. 24 is an end elevational view of the support shown in FIG. 22.
Figure 22:
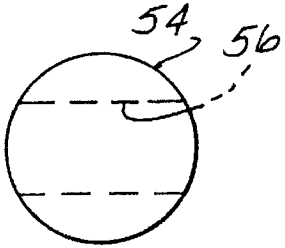
FIG. 22 is a plan view of a support for a cast-in-place passageway according to the present invention.
Figure 23:
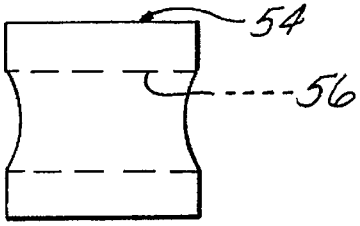
FIG. 23 is a side elevational view of the support shown in FIG. 22.

Referring now to FIGS. 22–24, a support 54 according to the present invention is disclosed for supporting a span of the passageway 12 between the ends 24 to keep the passageway 12 from warping due to differential heating during the casting process. The support 54 includes a longitudinally extending, open ended, aperture 56 allowing passage of the passageway 12 therethrough. Preferably, one surface 58 of the support 54 is formed for engagement with other supporting structure within the mold, such as a wall of the mold for forming the part 18 during casting. Preferably, the support 54 is formed of essentially the same material as the material being used to cast the part 18. As previously described, using the same material, or material having essentially the same machining characteristics, reduces or eliminates the complications associated with bi-metal machining operations.

The present invention provides a passageway that is completely formed and cast-in-place without the necessity of drilling straight, angled, cross, or intersecting apertures. The passageways 12 are opened during normal machining operations required after the casting process. Eliminating the need for drilling consequently eliminates broken drills and down time for drill and tool changes. The bore within the tube is smooth, even and consistent. The direction of flow is controlled in a position to the point of best application and is not a compromise of available drilling angles and intersecting lines. The casting can be made lighter by eliminating excess materials supplied only for the purpose of providing space to drill apertures. The process is also adaptable to existing casting processes with minimal effect to the existing casting process. Care must be exercised to reduce the amount of time that metal washes over the passageway 12 or the end closure fitting 10 during the pour of the casting process, and tight radius curves in the passageway 12 should be reduced during the design phase.

It should be understood that the article or part 18 can be cast in a mold by any conventional process. One or more tubes can be suspended in a mold, so that a cast member forms around the tubes. In effect, the tubes are encapsulated in the part 18 and form one or more passageways through the cast component. The tubes are never removed from the casting. The present invention eliminates the length of tube that previously would extend beyond the cast component that required additional machining operations to cut off the length of the tube, or to otherwise remove the exposed length of tube, and also presented difficulties in machining the finish surface of the part 18 due to the bi-metal surface be machined where the tube extended through the finish surface of the cast part. By using end closure fittings 10 of essentially the same material, or at the very least of material having comparable machining characteristics, the complications due to bi-metal surface compositions are dramatically reduced or eliminated. It is expected that the present invention can be adapted for use with plastic, ceramic, metallic, or hybrid composite combinations of tubing materials to be cast within any castable, i.e. molten, fluid or flowable, material. The tubes or passageways 18 can also be secured together by welding, or any other suitable method, prior to placement in the mold to retain the passageways 12 in any desired positional relationship with respect to one another. In addition, a single end closure fitting 10 may include a plurality of apertures 32 for receiving the ends 24 of a plurality of passageways 12 to be cast-in-place during a single pouring process.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A part having at least one passageway with an external periphery and an internal periphery to be cast-in-place within the part, the part cast by a process including the steps of providing an end fitting having a fitting body with at least one elongated, blind-ended, aperture formed therein, said aperture defined at least in part by a first surface having a complementary shape with respect to said external periphery of said cast-in-place passageway, said fitting body composed of material essentially identical to material to be used during casting of said part, receiving an end of said passageway disposed within said blind-ended aperture and extending at least partially within said fitting body, closing said passageway with said blind-end of said aperture in said fitting body, positioning said fitting body and attached passageway within a casting mold for forming said part to be cast with said blind-ended aperture disposed adjacent a wall of said casting mold, casting said part with said fitting body and attached passageway embedded therein, and machining said cast part to remove said blind-end of said aperture in said fitting body to open said passageway cast-in-place within said part, the cast part comprising:

at least one passageway with an external periphery and an internal periphery cast-in-place within the part; and at least one fitting body disposed adjacent a surface of said cast part, said fitting body having at least one elongated, blind-ended, aperture formed therein, said aperture defined at least in part by a first surface having a complementary shape with respect to said external periphery of said cast-in-place passageway for receiving an end of said passageway disposed extending at least partially therein to close said passageway during casting of said part, said fitting body composed of material essentially identical to material used during casting of said part, said fitting body positionable within a casting mold for forming said part to be cast, such that machining said cast part removes said blind-end of said aperture in said fitting body to open said passageway cast-in-place within said part.

2. The cast part of claim 1 further comprising:

a second aperture in said fitting, said second aperture having a complementary shape with respect to said external periphery of said cast-in-place passageway and disposed at an angle with respect to said aperture defined at least in part by said first surface and in communication therewith.

3. A cast part having at least one passageway with an external periphery and an internal periphery to be cast-in-place within said part comprising:

an end fitting disposed adjacent a surface of said cast part, said end fitting having a fitting body with at least one elongated, blind-ended, aperture formed therein, said aperture defined at least in part by a first surface having a complementary shape with respect to said external periphery of said cast-in-place passageway for receiving an end of said passageway disposed extending at least partially therein to close said passageway during casting of said part, said fitting body composed of material essentially identical to material used during casting of said part, said fitting body positionable within a casting mold for forming said part to be cast, such that machining said cast part removes said blind-end of said aperture within said fitting to open said passageway cast-in-place within said part.

4. The cast part of claim 3 further comprising:

a second aperture in said fitting, said second aperture having a complementary shape with respect to said external periphery of said cast-in-place passageway and disposed at an angle with respect to said aperture defined at least in part by said first surface and in communication therewith.

5. The cast part of claim 3 formed by the method comprising the steps of:

providing an end fitting having a fitting body with at least one elongated, blind-ended, aperture formed therein, said aperture defined at least in part by a first surface having a complementary shape with respect to said external periphery of said cast-in-place passageway, said fitting body composed of material essentially identical to material to be used during casting of said part;

receiving an end of said passageway disposed within said blind-ended aperture and extending at least partially within said fitting body;

closing said passageway with said blind-end of said aperture in said fitting body;

positioning said fitting body and attached passageway within a casting mold for forming said part to be cast with said blind-ended aperture disposed adjacent a wall of said casting mold;

casting said part with said fitting body and attached passageway embedded therein; and machining said cast part to remove said blind-end of said aperture in said fitting body to open said passageway cast-in-place within said part.

6. A cast part having at least one passageway with an external periphery and an internal periphery to be cast-in-place within said part comprising:

a fitting body having at least one elongated, blind-ended, aperture formed therein, said aperture defined at least in part by a first surface having a complementary shape with respect to said external periphery of said cast-in-place passageway for receiving an end of said passageway disposed extending at least partially therein to close said passageway during casting of said part, said fitting body composed of material essentially identical to material used during casting of said part, said fitting body positionable within a casting mold for forming said part to be cast, such that machining said cast part removes said blind-end of said aperture within said fitting to open said passageway cast-in-place within said part.

7. The cast part of claim 6 further comprising:

a second surface defining at least another portion of said aperture in said fitting, said second surface having a complementary shape with respect to said internal periphery of said cast-in-place passageway.

8. The cast part of claim 7 further comprising:

said second surface defining a portion of said aperture extending longitudinally and coaxially with said portion of said aperture defined by said first surface.

9. The cast part of claim 8 further comprising:

a transitional shoulder disposed between said first and second surfaces of said aperture, such that said cast-in-place passageway abuts against said shoulder when inserted within said fitting.

10. The cast part of claim 7 further comprising:

said second surface defining at least a portion of a second aperture having an axis disposed at an angle with respect to said aperture defined at least in part by said first surface.

11. The cast part of claim 6 further comprising:

a second aperture in said fitting, said second aperture having a complementary shape with respect to said external periphery of said cast-in-place passageway.

12. The cast part of claim 11 further comprising:

said second aperture coaxial with said portion of said aperture defined by said first surface.

13. The cast part of claim 11 further comprising:

said second aperture having an axis disposed at an angle with respect to said portion of said aperture defined at least in part by said first surface.

14. The cast part of claim 6 further comprising:

a locator pin formed on said fitting for cooperative engagement with a mold for forming said part during casting.

15. The cast part of claim 14 further comprising:

said locator pin having a hollow interior defined at least in part by a blind end wall communicating with said aperture, such that machining of said part after casting removes at least said blind end wall of said locator pin and opens said passageway cast-in-place within said part.

16. The cast part of claim 6 further comprising:

said fitting body having a generally flat, planar surface operably engageable with a mold for forming said part during casting.

17. The cast part of claim 6 further comprising:

said fitting body having a concave surface operably engageable with a mold for forming said part during casting.

18. The cast part of claim 6 further comprising:

said fitting body having a convex surface operably engageable with a mold for forming said part during casting.

19. The cast part of claim 6 further comprising:

a stand for supporting an intermediate portion of said cast-in-place passageway, said stand having at least one aperture extending therethrough of a shape and size complementary to said external periphery of said passageway.

20. A cast part having at least one passageway with an external periphery and an internal periphery to be cast-in-place within said part comprising:

a fitting body having at least one elongated, blind-ended, aperture formed therein, said aperture defined at least in part by a first surface having a complementary shape with respect to said external periphery of said cast-in-place passageway for receiving an end of said passageway disposed extending at least partially therein to close said passageway during casting of said part, said fitting body positionable with respect to said passageway during casting of said part, such that machining said cast part removes said blind-end of said aperture within said fitting to open said passageway cast-in-place within said part.

21. The cast part of claim 20 further comprising:

a second surface defining at least another portion of said aperture in said fitting, said second surface having a complementary shape with respect to said internal periphery of said cast-in-place passageway.

22. The cast part of claim 21 further comprising:

said second surface defining a portion of said aperture extending longitudinally and coaxially with said portion of said aperture defined by said first surface.

23. The cast part of claim 22 further comprising:

a transitional shoulder disposed between said first and second surfaces of said aperture, such that said cast-in-place passageway abuts against said shoulder when inserted within said fitting.

24. The cast part of claim 21 further comprising:

said second surface defining at least a portion of a second aperture having an axis disposed at an angle with respect to said aperture defined at least in part by said first surface.

25. The cast part of claim 20 further comprising:

a second aperture in said fitting, said second aperture having a complementary shape with respect to said external periphery of said cast-in-place passageway.

26. The cast part of claim 25 further comprising:

said second aperture coaxial with said portion of said aperture defined by said first surface.

27. The cast part of claim 25 further comprising:

said second aperture having an axis disposed at an angle with respect to said portion of said aperture defined at least in part by said first surface.

28. The cast part of claim 20 further comprising:

a locator pin formed on said fitting for cooperative engagement with a mold for forming said part during casting.

29. The cast part of claim 28 further comprising:

said locator pin having a hollow interior defined at least in part by a blind end wall communicating with said aperture, such that machining of said part after casting removes at least said blind end wall of said locator pin and opens said passageway cast-in-place within said part.

30. The cast part of claim 20 further comprising:

said fitting body having a generally flat, planar surface operably engageable with a mold for forming said part during casting.

31. The cast part of claim 20 further comprising:

said fitting body having a concave surface operably engageable with a mold for forming said part during casting.

32. The cast part of claim 20 further comprising:

said fitting body having a convex surface operably engageable with a mold for forming said part during casting.

33. The cast part of claim 20 further comprising:

a stand for supporting an intermediate portion of said cast-in-place passageway, said stand having at least one aperture extending therethrough of a shape and size complementary to said external periphery of said passageway.

34. The cast part of claim 20 further comprising:

said fitting body composed of material having comparable machining characteristics to material used during casting of said part.

35. The cast part of claim 20 further comprising:

said fitting body composed of material essentially identical to material used during casting of said part.

36. The cast part of claim 20 further comprising:

said fitting body having a locator surface formed on said fitting for cooperative engagement with a locator-receiving surface of a mold for forming said part during casting, said locator surface positionable with respect to said mold to hold said at least one passageway in position during casting of said part.

* * * * *